US008480058B2

(12) United States Patent
Matthews

(10) Patent No.: US 8,480,058 B2
(45) Date of Patent: Jul. 9, 2013

(54) SHEET MATERIAL LIFTS

(76) Inventor: William Matthews, Alsea, OR (US)

( * ) Notice: Subject to any disclaimer, the term of this patent is extended or adjusted under 35 U.S.C. 154(b) by 378 days.

(21) Appl. No.: 12/826,573

(22) Filed: Jun. 29, 2010

(65) Prior Publication Data

US 2011/0091303 A1 Apr. 21, 2011

Related U.S. Application Data

(60) Provisional application No. 61/252,646, filed on Oct. 17, 2009.

(51) Int. Cl.
*B66F 19/00* (2006.01)
*B23P 19/04* (2006.01)

(52) U.S. Cl.
USPC ..... 254/30; 254/120; 254/134; 414/11

(58) Field of Classification Search
USPC ..... 280/655; D34/24–27; D8/88; 254/25, 254/30, 120, 129; 410/51; 414/11
See application file for complete search history.

(56) References Cited

U.S. PATENT DOCUMENTS

| | | | | | |
|---|---|---|---|---|---|
| D31,647 | S | * | 10/1899 | Knowles | D34/26 |
| 897,853 | A | * | 9/1908 | Vom Scheidt | 410/51 |
| 1,512,454 | A | * | 10/1924 | Cade | 280/47.27 |
| 2,406,183 | A | * | 8/1946 | Allen | 280/655 |
| 2,574,825 | A | * | 11/1951 | Guild | 414/456 |
| D166,005 | S | * | 2/1952 | Summerhill | D34/26 |
| 2,704,165 | A | * | 3/1955 | Hoover | 414/456 |
| 2,801,861 | A | * | 8/1957 | Hanson | 280/43.2 |
| D245,595 | S | * | 8/1977 | Johnson | D34/26 |
| 4,278,244 | A | * | 7/1981 | Carter | 269/17 |
| 4,756,540 | A | * | 7/1988 | Crawford | 280/47.21 |
| 4,838,521 | A | * | 6/1989 | Moisan | 254/131 |
| 5,160,154 | A | * | 11/1992 | Seydel et al. | 280/47.19 |
| D353,928 | S | * | 12/1994 | Michael, Jr. | D34/26 |
| D361,189 | S | * | 8/1995 | Smeitink | D34/26 |
| 5,460,469 | A | | 10/1995 | Young | |
| 5,529,287 | A | * | 6/1996 | Pelosi et al. | 254/129 |
| 5,988,659 | A | | 11/1999 | Young | |
| 6,250,655 | B1 | * | 6/2001 | Sheeks | 280/79.7 |
| 6,511,275 | B2 | | 1/2003 | Ray | |
| 6,540,242 | B1 | * | 4/2003 | Raichlen | 280/47.27 |
| 7,100,313 | B2 | * | 9/2006 | Scherer | 37/265 |
| 7,101,136 | B1 | | 9/2006 | Ray et al. | |
| 7,104,554 | B2 | * | 9/2006 | Perras | 280/47.27 |
| 7,387,293 | B2 | * | 6/2008 | Boucher | 254/131 |
| D592,822 | S | * | 5/2009 | Boucher et al. | D34/31 |
| D635,320 | S | * | 3/2011 | Paoletto | D34/26 |
| 2001/0029715 | A1 | * | 10/2001 | Bradley et al. | 52/344 |
| 2008/0251773 | A1 | * | 10/2008 | Smeeton et al. | 254/113 |

(Continued)

*Primary Examiner* — Joseph J Hail
*Assistant Examiner* — Marc Carlson
(74) *Attorney, Agent, or Firm* — Mohr Intellectual Property Law Solutions, PC

(57) ABSTRACT

Sheet material lifts including an elongate body extending along a longitudinal axis between a first end and a second end, a foot extending transverse the longitudinal axis from the second end of the elongate body, a support element disposed on the foot distal the elongate body, a base defining a fulcrum coupled to the foot, and an arm extending transverse the longitudinal axis from the elongate body at a position intermediate the first end and the second end. In some examples, the arm includes a sleeve, and a shaft slidingly mounted within the sleeve, the shaft being configured to slide along a path between a retracted position proximate the elongate body and an extended position distal the elongate body.

18 Claims, 2 Drawing Sheets

U.S. PATENT DOCUMENTS

2010/0044657 A1* 2/2010 Patrick et al. ..... 254/130
2010/0102284 A1* 4/2010 Drake ..... 254/1
2011/0214274 A1* 9/2011 Holder ..... 29/428
2012/0061631 A1* 3/2012 Edwards ..... 254/129

* cited by examiner

SHEET MATERIAL LIFTS

This application claims the benefit of U.S. Provisional Application, Ser. No. 61/252,646, filed on Oct. 17, 2009, which is hereby incorporated by reference for all purposes.

BACKGROUND

The present disclosure relates generally to sheet material lifts. In particular, sheet material lifts for use with construction sheet materials are described herein.

Typically, a sheet of drywall to be installed upon the support beams of a wall or ceiling is made of crushed gypsum sandwiched between layers of felt paper. The sheet is usually about 4 feet by 8 feet in size and may weigh between 75 and 100 pounds, depending on its constituent materials. Such a sheet is unwieldy and may be extremely difficult for one person to handle during installation.

Known sheet material lifts, which are sometimes referred to as drywall jacks for drywall specific applications, are not entirely satisfactory for the range of applications in which they are employed. For example, existing sheet material lifts include a number of articulating components, are complex to use and operate, and are in general quite cumbersome. Some sheet material jacks avoid some of the complexity of other known sheet material lifts, but are difficult and/or unstable in use.

Further, typical sheet material lifts require that the user attend to the jack at all times to maintain the sheet material in a desired position. This requirement occupies the user's hands and prevents the user from stepping away from the jack. When a user must maintain the sheet material in a desired position, he may require a second person to fasten the piece of sheet material to the wall, which increases the labor expense of a job. Lacking a second person, the user of conventional sheet material lifts risks injury and/or inaccurate placement of the sheet material when attempting to fasten sheet material by himself.

Thus, there exists a need for sheet material lifts that improve upon and advance the design of known sheet material lifts. Examples of new and useful sheet material lifts relevant to the needs existing in the field are discussed in the sections below.

Disclosure addressing one or more of the identified existing needs is provided in the detailed description below. References relevant to sheet material lifts include U.S. patent References: U.S. Pat. No. 5,460,469, U.S. Pat. No. 5,988,659, U.S. Pat. No. 6,511,275, U.S. Pat. No. 7,101,136, and U.S. Pat. No. 7,387,293. The complete disclosures of the above patent references are herein incorporated by reference for all purposes.

SUMMARY

The present disclosure is directed to sheet material lifts including an elongate body extending along a longitudinal axis between a first end and a second end, a foot extending transverse the longitudinal axis from the second end of the elongate body, a support element disposed on the foot distal the elongate body, a base defining a fulcrum coupled to the foot, and an arm extending transverse the longitudinal axis from the elongate body at a position intermediate the first end and the second end. In some examples, the arm includes a sleeve and a shaft slidingly mounted within the sleeve, the shaft being configured to slide along a path between a retracted position proximate the elongate body and an extended position distal the elongate body.

DETAILED DESCRIPTION

The disclosed sheet material lifts will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various sheet material lifts are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figures 1, 2:
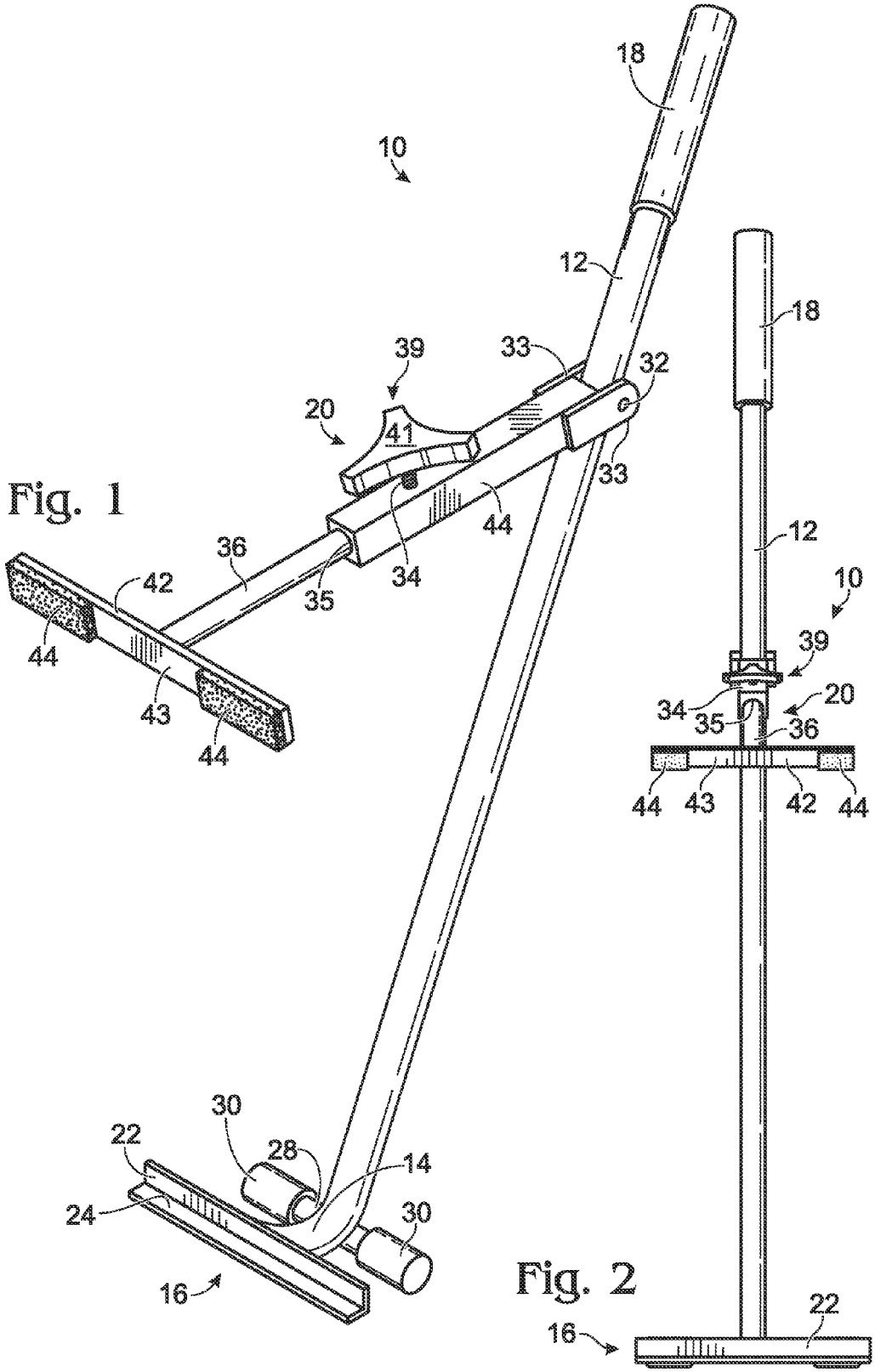
FIG. 1 is a perspective view of a first example of a sheet material lift.
FIG. 2 is a front side elevation view of the sheet material lift shown in FIG. 1.

With reference to FIG. 1, a sheet material lift 10 includes an elongated body 12 that extends to a foot 14, a support element 16, and a fulcrum 28. One end of lift 10 includes a grip or handle 18 that may make the lift easier to maneuver or grasp when manipulating a supported sheet of building material. At a mid-portion of elongated body 12, the illustrated embodiment of lift 10 includes an arm 20 useful for supporting or stabilizing a sheet of building material.

Figure 4:
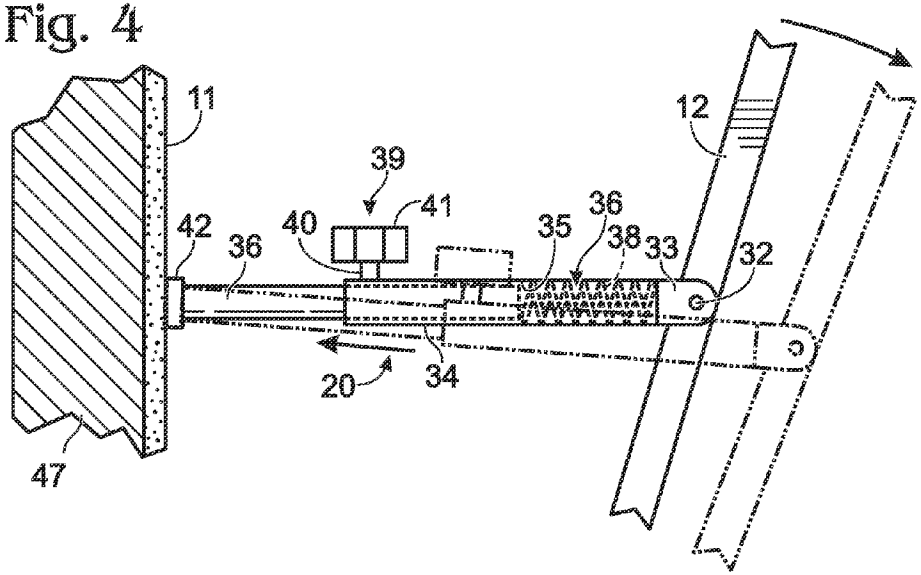
FIG. 4 is a close up left side elevation view of an arm of the sheet material lift shown in FIG. 1 depicted in extended and retracted positions.
Figure 5:
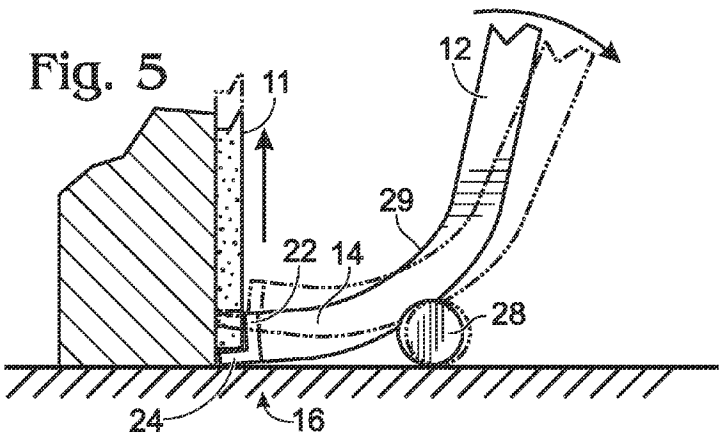
FIG. 5 is a close up left side elevation view of a foot of the sheet material lift shown in FIG. 1 depicted in rest and lift positions.
Figure 3:
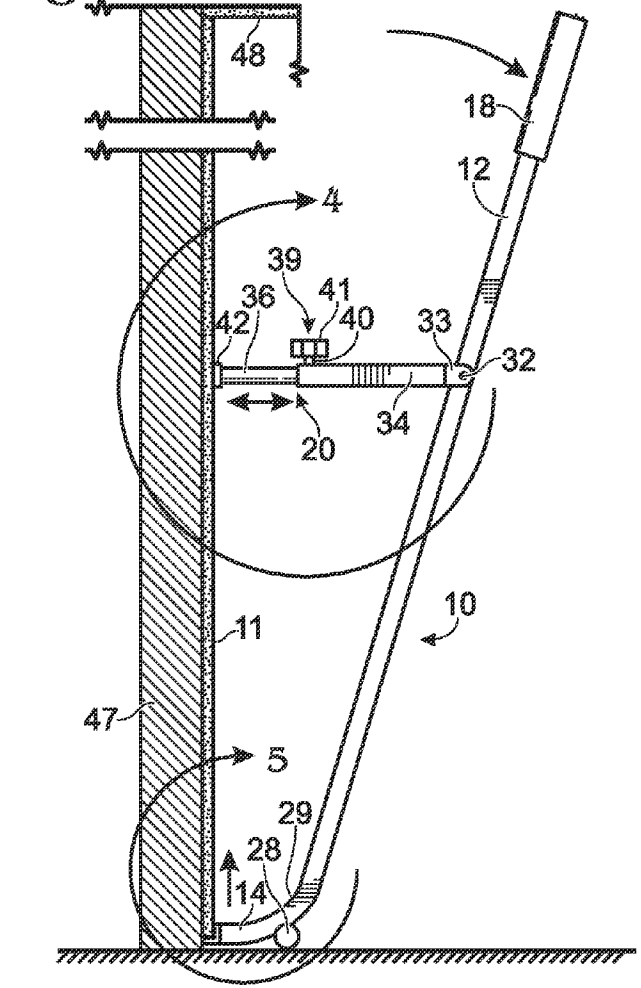
FIG. 3 is a left side elevation view of the sheet material lift shown in FIG. 1 depicted in a lift position supporting a sheet of material at a desired height.

FIGS. 3-5 depict a lower portion of a sheet of building material 11 being supported by lift 10 on support element 16 of foot 14. As shown in FIGS. 1 and 5, support element 16 includes a vertical member 22 and a horizontal member 24 with which building material 11 may interact to securely support the building material. One or both of the horizontal and vertical members may include padding as an optional feature.

As shown in FIGS. 1, 3, and 5, lift 10 includes fulcrum element 28 near a bend 29 in body 12. Fulcrum 28 helps raise the sheet building material off the ground, or floor, as it is being manipulated or installed. As shown in FIG. 5, body 12 and foot 14 pivot around fulcrum 28 between a rest position, shown in solid lines, and a lift position, shown in dashed lines.

In the particular example shown in FIGS. 1-3 and 5, fulcrum 28 is six inches long and constructed of one-and-a-quarter-inch steel pipe. In some examples, the fulcrum is selected to have an outer surface having a relatively high coefficient of friction to provide a slip resistant or nonslip grip when supporting the lift from the ground.

In the particular design shown in FIGS. 1-3 and 5, fulcrum element 28 includes protective caps 30 upon which lift 10 contacts the floor or other surface. Protective caps 30 are formed from a material having a relatively high coefficient of friction (in this example, rubber) to provide a slip resistant outer surface. In other designs, the fulcrum may include other appropriate floor-contacting features, such as wheels with or without locks.

The length ratio between elongate body 12 and foot 14 increases the mechanical advantage of lift 10 by increasing the arc length traveled by handle 18 when lift 10 is tilted about fulcrum element 28. The lever action resulting from the increased arc length reduces the force a user must exert to raise a given weight of support material.

In the example shown in FIGS. 1-5, lift 10 has a body-to-foot length ratio of approximately 8:1, with elongate body 12 being approximately 48 inches long and foot 14 being approximately 6 inches long. In other examples, length ratios of 3:1 to 12:1 are used. Length ratios of 5:1 and higher have been observed to provide sufficient mechanical advantage to enable persons possessing a wide range of strength to use and operate the lift for sheets of material having considerable weight, such as drywall.

As noted, the illustrated lift 10 includes a support arm 20 near a mid-point of its body 12. As shown in FIGS. 3 and 4, support arm 20 functions to support a central portion of sheet material 11 being lifted by lift 10. Support arm 20 is coupled to body 12 via a pin 32 that passes through concentric apertures defined by body 12 and support arm 20.

As shown in FIGS. 1, 3, and 4, arm 20 includes plates 33 defining apertures for pin 32 to pass through. Plates 33 extend from an end of support arm 20 proximate body 12. In the depicted embodiment, plates 33 are each one-quarter inch by one-inch by three-inch plate steel.

In the present embodiment, pin 32 couples plates 33 of support arm 20 to body 12 approximately 34 inches from fulcrum 28. In other embodiments, the pin couples the plates to the body at different heights to position the support arm at different positions. The height of the support arm on the body may be preselected based on the height of the material intended to be lifted and installed with the lift.

In some examples, the support arm and the body are complimentarily configured to enable the support arm to be mounted at a variety of positions along the length of the body. For instance, the body may define a series of longitudinally spaced holes along the body through which the pin may be inserted to secure the support arm to the body at a variety of heights. In other examples, the support arm secures to the body at a desired position via a selectively engageable clamp providing a selective friction fit.

The illustrated embodiment of support arm 20 includes a proximal sleeve or housing 34 and a distal shaft or cylinder 36 mounted within a bore 35 of sleeve 34. Here, "proximal" denotes a position closer to body 12 and "distal" denotes a position further from body 12. Bore 35 defines a path along which shaft 36 may slide relative to sleeve 34 between a retracted position (shown in solid lines in FIG. 4) proximate elongate body 12 and an extended position (shown in dashed lines) distal elongate body 12.

In the example shown in FIGS. 1-5, arm 20 includes a biasing mechanism 37 to bias shaft 36 away from body 12. As shown in FIG. 4, biasing mechanism 37 includes a resilient spring 38 disposed within bore 35 between ends of sleeve 34 and shaft 36 proximate body 12. Spring 38 provides a distally-directed force against shaft 36 away from elongate body 12. As shown in FIGS. 3 and 4, the distally-directed force presses shaft 36 into abutment with sheet of material 11 supported by lift 10. Any known biasing mechanism, such as resilient members and resilient cables, may be used to bias the shaft toward a desired position.

As shown in FIGS. 1-4, to lock shaft or cylinder 36 in a desired position, the illustrated support arm 20 includes a locking mechanism 39. With reference to FIG. 4, locking mechanism 39 includes a threaded member 40 and a knob 41 mounted to threaded member 40. Threaded member 40 passes through a threaded aperture of a wall of sleeve 34 adjacent the path along which shaft 36 slides. When moving through the aperture, threaded member 40 moves along a path transverse to the path along which shaft 36 slides within bore 35.

A user may use knob 41 to rotate threaded member 40 about its longitudinal axis. Rotating threaded member 40 causes it to ride along its threads in complimentarily configured channels to move between a locking position and a withdrawn position. In the locking position, a leading end of threaded member 40 engages shaft 36 and restricts its movement. In the withdrawn position, threaded member 40 is spaced from shaft 36 and does not restrict shaft 36 from sliding within bore 35.

The arm 20 may include structure to inhibit or prevent the shaft from being forced completely out of the sleeve. Suitable structure to retain the shaft at least partially within the sleeve includes a detent mechanism, a frictional engagement of a proximal portion of the shaft with a distal portion of the sleeve, a lip formed on a distal portion of the sleeve, or an elongate tension bearing member of an appropriate length coupled to the shaft and the sleeve or the body.

As shown in FIGS. 1 and 2, the distal end of support arm 20 includes a stabilizer member 42 defining a vertical surface 43 distal elongate body 12. As shown in FIGS. 1 and 2, stabilizer member 42 extends laterally relative to the longitudinal axis defined by elongate body 12. As shown in FIGS. 3 and 4, vertical surface 43 of stabilizer member 42 contacts sheet of material 11 being lifted by lift 10 to provide lateral stability to the sheet of material. In the example shown in FIGS. 1 and 2, stabilizer member 42 includes optional pads 44 mounted on vertical surface 43 to reduce the potential for scraps and scuffs on the sheet of material being lifted.

A typical embodiment of the lift may be constructed substantially of steel tubing of various sizes and shapes. Although other constructions are possible if they are of sufficient strength to support desired sheet materials. For example, the body may be constructed of one-inch diameter ANSI Schedule 40 steel pipe. In the illustrated embodiment, body 12 is a 54-inch long, one-inch diameter, ANSI Schedule 40 steel pipe.

At the point where body 12 becomes foot 14, body 12 of the illustrated embodiment is bent to an obtuse angle. In the particular example shown in FIGS. 1-3 and 5, the obtuse angle is approximately 114-degrees around a two-inch radius (though other constructions and angles are possible). An obtuse angle increases the space between elongate body 12 and sheet of material 11 loaded onto lift 10. This increased space has been observed to improve the convenience and effectiveness of the lift in operation.

In the example depicted in FIGS. 1-3 and 5, both support element 16 and stabilizing bar 42 are constructed of one-inch by one-inch angle iron. However, the support element and the stabilizing bar may be any desired thickness. In the example shown in FIGS. 1-3 and 5, support element 16 is fourteen inches long and stabilizing bar 42 is eight inches long.

In the specific, non-limiting example shown in the figures, sleeve 34 of support arm 20 is eight inches long and fashioned from one-inch by one-inch square tubing. Further, shaft 36 of support arm 20 is eight inches long and fashioned from three-quarter-inch by three-quarter-inch square tubing. In the illustrated embodiment, resilient spring 38 mounted within sleeve 34 is three-quarters of an inch in diameter and six inches in length.

In the illustrated embodiment, since the majority of the elements are steel, most of the connections between elements are made by welding them together. If other materials are used, then different coupling techniques may be used, as necessary. Also, as noted earlier, the dimensions of the various elements are exemplary, such that any appropriate dimensions and gauges of pipe, tubing, or solid pieces can be chosen for a specific application without departing from the principles of the present disclosure.

FIGS. 3-5 depict lift 10 in use with a sheet 11 of drywall. In operation, a user places sheet 11 on the lift such that a lower portion of sheet 11 is supported by horizontal member 24 of support element 16. In this configuration a central portion of sheet 11 rests against stabilizing member 42 of support arm 20, which is in the retracted position. The user may then move the lift supporting the sheet nearer to a wall 47 to which the sheet will be fastened.

As shown in FIG. 3, lift 10 supports sheet 11 against wall 47 and ceiling 48 when tilted to the lift position near wall 47. With reference to FIGS. 3 and 5, the reader can see that pulling on handle 18 pivots body 12 and foot 14 about fulcrum 28 between the rest position, shown in solid lines, and the lift position, shown in dashed lines. Pivoting body 12 and foot 14 between the rest position and the lift position raises and lowers the height of sheet 11. In a typical embodiment, fulcrum 28, support element 16, and support arm 20 will operate together to raise the sheet 11 of building material so that sheet 11 is substantially flush with ceiling 48 at its upper edge, and approximately one-half inch off the ground at its lower edge.

After pulling back hand 18 to lift sheet 11 to be flush with ceiling 48, the user may extend shaft 36 of support arm 20 to abut the interior face of sheet 11. Extending shaft 36 is accomplished by turning knob 41 in the direction configured to move threaded member 40 away from shaft 36. Moving threaded member 40 away from shaft 36 allows shaft 36 to extend toward sheet material 11 and away from body 12 under the bias of spring 38.

When stabilizer member 42 of shaft 36 abuts the interior face of sheet 11, the user may lock arm 20 in this extended position. Locking arm 20 in the extended position is accomplished by turning knob 41 to move threaded member into contact with shaft 36; thereby restricting shaft 36 from moving within bore 35 of sleeve 34. When arm 20 is locked in the extended position and abutting sheet 11, it serves to brace or hold lift 10 in the lift position, i.e., to restrict lift 10 from tilting about fulcrum 28 to the rest position.

Once arm 20 is locked into a position abutting sheet 11 lifted tight against ceiling 48, the relatively high friction surface of fulcrum 28 restricts lift from sliding away from the wall. In preferred examples, a sufficiently non-slip surface material for fulcrum 28 is selected to resist the force of sheet 11 pushing downward on foot 14 and causing fulcrum 28 to slide away from the wall.

The combination of the tight fit of sheet 11 against ceiling 48, arm 20 locked in an extended position holding body 12 in the lift position, and the non-slip grip of fulcrum 28 create a stable position. Once sheet 11 is manipulated into the stable position, the user can safely leave lift 10 unattended, such as to walk away from the lift to mark measurements, pick up tools, or consult building plans. Further, in the stable position, the user can use both hands to fasten sheet 11 to wall 47.

In some examples, the lift includes a vertical height adjustment mechanism to raise and lower the height of the foot. Raising the foot may be accomplished by raising the entire body of the lift or may involve raising the foot relative to the elongate body. In some examples, the fulcrum is raised with the foot and in others the fulcrum remains on the ground. Any suitable vertical height adjustment mechanisms may be used, including jacks, hydraulic cylinders, ratchet mechanisms, and sliding concentric members with appropriate locking mechanisms.

Raising and lowering the height of the foot enables the lift to be used for positioning material at a variety of vertical positions off the ground. For example, when installing exterior siding, the foot may be raised 60" or more off the ground to position the foot at the height needed to lift and secure a given row of siding. The foot may be raised in selected increments, such as 1" increments, or the lift may allow for substantially continuous vertical positions of the foot.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A sheet material lift, comprising:

an elongate body extending along a longitudinal axis between a first end and a second end;

a foot extending transverse the longitudinal axis from the second end of the elongate body;

a support element disposed on the foot distal the elongate body;

a base defining a fulcrum coupled to the foot; and an arm extending transverse the longitudinal axis from the elongate body at a position intermediate the first end and the second end;

wherein the arm includes:

a sleeve;

a shaft slidingly mounted within the sleeve; and a biasing mechanism biasing the shaft to slide away from the elongate body.

2. The sheet material lift of claim 1, wherein the foot is curved.

3. The sheet material lift of claim 1, wherein the foot is defined by a bent portion of the elongate body.

4. The sheet material lift of claim 1, wherein the base includes a slip resistant outer surface.

5. The sheet material lift of claim 1, wherein the elongate body and the foot define an obtuse angle.

6. The sheet material lift of claim 1, wherein the length of the elongate body is at least five times the length of the foot to provide users with a preselected minimum amount of mechanical advantage when using the sheet material lift.

7. The sheet material lift of claim 1, wherein the support element includes a horizontal lift member and a vertical backstop.

8. The sheet material lift of claim 1, wherein the arm and the foot extend from the elongate body in substantially the same direction transverse to the longitudinal axis.

9. The sheet material lift of claim 1, wherein the biasing mechanism includes a spring.

10. The sheet material lift of claim 1, wherein the arm further comprises a locking mechanism configured to selectively restrict the shaft from sliding away from the elongate body.

11. The sheet material lift of claim 1, wherein the arm further comprises a stabilizer member mounted to the shaft distal the elongate body, the stabilizer member extending laterally relative to the longitudinal axis.

12. The sheet material lift of claim 11, further comprising pads mounted to the stabilizer member in a position distal the elongate body.

13. The sheet material lift of claim 1, wherein the arm is mounted to the elongate body with a pivoting connection.

14. A sheet material lift, comprising:

an elongate body defining a bend and a foot extending from the bend, the foot being configured to support a sheet of material;

a support arm extending from the elongate body, the support arm including:

a sleeve, and a shaft slidingly mounted within the sleeve, the shaft being configured to slide along a path between a retracted position proximate the elongate body and an extended position distal the elongate body;

a biasing mechanism biasing the shaft toward the extended position; and a fulcrum element coupled to the elongate body proximate the bend.

15. The sheet material lift of claim 14, wherein the support arm further comprises a locking mechanism configured to selectively lock the shaft into a given position.

16. The sheet material lift of claim 15, wherein the locking mechanism includes a threaded member mounted to the sleeve transverse to the path, the threaded member moving between a locking position engaging the shaft and a withdrawn position spaced from the shaft.

17. The sheet material lift of claim 14, wherein the fulcrum element includes a slip resistant outer surface.

18. The sheet material lift of claim 14, further comprising a slip resistant attachment mounted to the fulcrum element.

* * * * *